US008018389B2

(12) United States Patent
Chiang et al.

(10) Patent No.: US 8,018,389 B2
(45) Date of Patent: Sep. 13, 2011

(54) METHODS AND APPARATUS FOR IMPROVING THE PERFORMANCE OF AN ELECTRONIC DEVICE HAVING ONE OR MORE ANTENNAS

(75) Inventors: Bing Chiang, Cupertino, CA (US); Gregory Allen Springer, Sunnyvale, CA (US); Douglas B. Kough, San Jose, CA (US); Enrique Ayala, Watsonville, CA (US); Matthew Ian McDonald, San Jose, CA (US)

(73) Assignee: Apple Inc., Cupertino, CA (US)

( * ) Notice: Subject to any disclaimer, the term of this patent is extended or adjusted under 35 U.S.C. 154(b) by 1260 days.

(21) Appl. No.: 11/702,039

(22) Filed: Feb. 1, 2007

(65) Prior Publication Data

US 2008/0165071 A1 Jul. 10, 2008

(51) Int. Cl.
*H01Q 9/00* (2006.01)

(52) U.S. Cl. ..... 343/745; 343/749; 343/767

(58) Field of Classification Search ..... 343/767, 343/745, 749

See application file for complete search history.

(56) References Cited

U.S. PATENT DOCUMENTS

| | | | | |
|---|---|---|---|---|
| 5,955,995 | A | 9/1999 | Silverstein | |
| 6,285,333 | B1 | 9/2001 | Reed et al. | |
| 6,369,771 | B1 | 4/2002 | Chiang et al. | |
| 6,670,923 | B1 | 12/2003 | Kadambi et al. | |
| 6,741,214 | B1 | 5/2004 | Kadambi et al. | |
| 6,747,601 | B2 | 6/2004 | Boyle | |
| 6,774,852 | B2 | 8/2004 | Chiang et al. | |
| 6,828,941 | B2 * | 12/2004 | King et al. | 343/767 |
| 6,856,294 | B2 | 2/2005 | Kadambi et al. | |
| 6,888,510 | B2 | 5/2005 | Jo et al. | |
| 6,980,154 | B2 | 12/2005 | Vance et al. | |
| 7,027,838 | B2 | 4/2006 | Zhou et al. | |
| 7,116,276 | B2 | 10/2006 | Lee | |
| 7,119,747 | B2 | 10/2006 | Lin et al. | |
| 7,123,200 | B1 * | 10/2006 | Smith et al. | 343/709 |
| 7,123,208 | B2 | 10/2006 | Baliarda et al. | |
| 7,176,842 | B2 * | 2/2007 | Bettner et al. | 343/767 |
| 7,187,337 | B2 * | 3/2007 | Aikawa et al. | 343/767 |
| 7,239,290 | B2 | 7/2007 | Poilasne et al. | |
| 2003/0107518 | A1 | 6/2003 | Li et al. | |

(Continued)

FOREIGN PATENT DOCUMENTS

JP 08242118 A 9/1996

(Continued)

OTHER PUBLICATIONS

Hill et al. U.S. Appl. No. 11/650,187, filed Jan. 4, 2007.

(Continued)

*Primary Examiner* — Tan Ho
(74) *Attorney, Agent, or Firm* — David C. Kellogg

(57) ABSTRACT

An electronic device comprising a first conductive unit and a second conductive unit disposed such that a gap exists between the first component and the second component. The electronic device further includes one or more components disposed along the gap and configured to counteract one or more capacitance effects in the gap, wherein at least one of the first conductive unit and the second conductive unit represents a part of an antenna. By counteracting the capacitance effects in the gap, certain radiation attributes of the antenna, such as radiation efficiency, can be improved. The one or more components are also employed to counteract one or more capacitance effects in a slot of a conductive unit in an electronic device.

17 Claims, 9 Drawing Sheets

U.S. PATENT DOCUMENTS

| | | | | |
|---|---|---|---|---|
| 2003/0122721 | A1 | 7/2003 | Sievenpiper | |
| 2004/0145521 | A1 | 7/2004 | Hebron et al. | |
| 2004/0160367 | A1 | 8/2004 | Mendolia et al. | |
| 2006/0055606 | A1 | 3/2006 | Boyle | |
| 2008/0258985 | A1 * | 10/2008 | Ryou et al. | 343/746 |

FOREIGN PATENT DOCUMENTS

| | | | |
|---|---|---|---|
| JP | 2005514844 | A | 5/2005 |
| WO | 2007/000749 | A1 | 1/2007 |

OTHER PUBLICATIONS

R. Bancroft "A Commercial Perspective on the Development and Integration of an 802.11a/b/g HiperLan/WLAN Antenna into Laptop Computers", IEEE Antennas and Propagation Magazine, vol. 48, No. 4, Aug. 2006, pp. 12-18.

B. Chiang et al. "Invasion of Inductor and Capacitor Chips in the Design of Antennas and Platform Integration", IEEE International Conference on Portable Information Devices, May 2007, pp. 1-4.

A. Lai et al. "Infinite Wavelength Resonant Antennas With Monopolar Radiation Pattern Based on Periodic Structures", IEEE Transactions on Antennas and Propagation, vol. 55, No. 3, Mar. 2007, pp. 868-876.

Hill et al. U.S. Appl. No. 11/821,192, filed Jun. 21, 2007.

Hill et al. U.S. Appl. No. 11/897,033, filed Aug. 28, 2007.

Zhang et al. U.S. Appl. No. 11/895,053, filed Aug. 22, 2007.

Chiang et al. U.S. Appl. No. 11/958,824, filed Dec. 18, 2007.

Chiang et al. U.S. Appl. No. 12/759,598, filed Apr. 13, 2010.

R. Bancroft "A Commercial Perspective on the Development and Integration of an 802.11a/b/g HiperLan/WLAN Antenna into Laptop Computers", IEEE Antennas and Propagation Magazine, vol. 48, No. 4, Aug. 2006, pp. 12-18.

B. Chiang et al. "Invasion of Inductor and Capacitor Chips in the Design of Antennas and Platform Integration", IEEE International Conference on Portable Information Devices, May 2007, pp. 1-4.

A. Lai et al. "Infinite Wavelength Resonant Antennas With Monopolar Radiation Pattern Based on Periodic Structures", IEEE Transactions on Antennas and Propagation, vol. 55, No. 3, Mar. 2007, pp. 868-876.

* cited by examiner

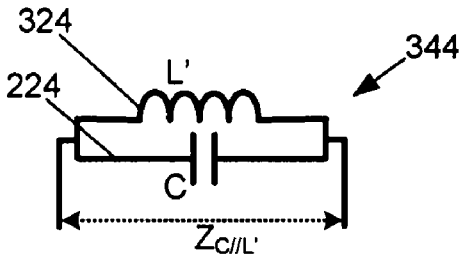

$Z_{C//L'} = ((1/j\omega C)\cdot j\omega L') / (1/j\omega C + j\omega L')$ ..... (401)

wherein $Z_{C//L'}$ = impedance of tank circuit 344

C = capacitance per unit length of conductive line 208

L' = added shunt inductance per same unit length of conductive line 208

$\omega = 2\pi f$ f = operating frequency $Z_{C//L'} \rightarrow \infty$, if $1/j\omega C + j\omega L' = 0$ ..... (402)

$L' = 1/\omega^2 C$ ..... (403)

or $\omega = SQRT(1/L'C)$ ..... (404)

Fig. 4

Number of added components ≥ 3/(λ/(4D)) , i.e.,
Number of added components ≥ 12D/λ ..... (501)

wherein

D = length of gap 504

λ = wavelength of radiation

λ = c/f ..... (502)

wherein c = velocity of light f = operating frequency

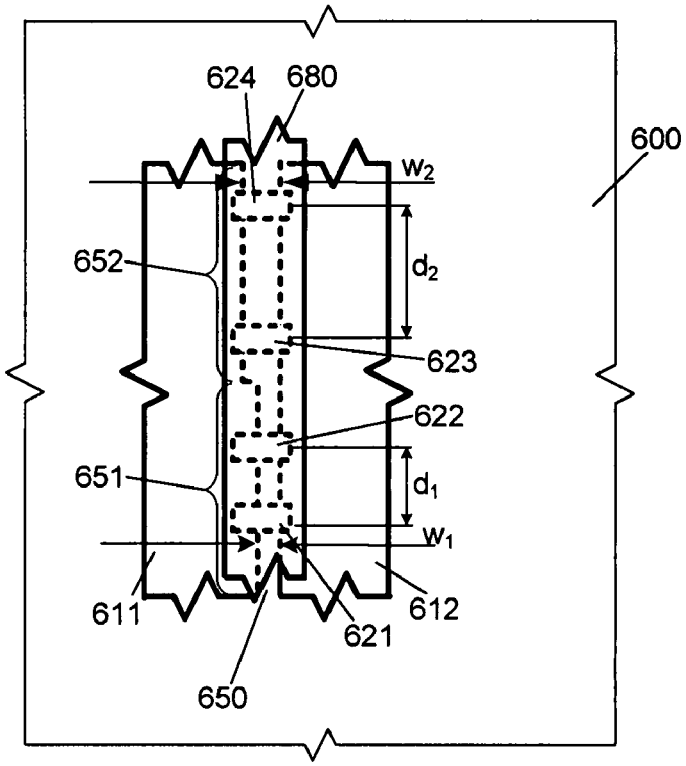

$Z_e = j\omega L' / (1 - \omega^2 L'C)$ ..... (601)
$Z_e = 1/j\omega C_e$ ..... (602)
$C_e = C - 1/(\omega^2 L')$ ..... (603)

wherein $Z_e$ = an effective impedance of a tank circuit modeling a section of gap 650,
C = a capacitance value of the tank circuit,
L' = an inductance value of the tank circuit,
$\omega = 2\pi f$, f = operating frequency, and
$C_e$ = an effective capacitance for the section of gap 650.

$d_1 = w_1 \cdot C_{e1}/\varepsilon = (w_1/\varepsilon)(C_1 - 1/(\omega^2 L_1'))$ ..... (604)
$d_2 = w_2 \cdot C_{e2}/\varepsilon = (w_2/\varepsilon)(C_2 - 1/(\omega^2 L_2'))$ ..... (605)

wherein $\varepsilon$ = permittivity of gap 650,
$C_{e1}$ = an effective capacitance for section 651,
$C_1$ = a capacitance effect to be neutralized in section 651,
$L_1'$ = an inductance value of component 621 or 622,
$C_{e2}$ = an effective capacitance for section 652,
$C_2$ = a capacitance effect to be neutralized in section 652, and
$L_2'$ = an inductance value of component 623 or 624.

Fig. 6

METHODS AND APPARATUS FOR IMPROVING THE PERFORMANCE OF AN ELECTRONIC DEVICE HAVING ONE OR MORE ANTENNAS

BACKGROUND OF THE INVENTION

For electronic devices, miniaturization can provide significant advantages such as, for example, improved portability and/or reduced costs for storage, packaging, and/or transportation. However, miniaturization of an electronic device can be hindered by various physical constraints.

For example, in an electronic device, a gap having a sufficient width between two conductive units may be required to enable the electronic device to satisfy one or more performance requirements. The performance requirements can include one or more of electromagnetic wave transmission efficiency, radio signal reception efficiency, heat dissipation efficiency, etc. If the gap is narrowed for miniaturizing the electronic device, the performance of the electronic device can be compromised. If the gap is enlarged to improve the performance of the electronic device, the form factor of the electronic device can become undesirably large.

Techniques have been developed to physically widen the gap without enlarging the electronic device. However, the performance of the electronic device can be unacceptable in some situations when such prior art techniques are employed. A gap in a prior-art electronic device and a prior-art gap-widening arrangement are discussed with reference to FIGS. 1A-B.

FIG. 1A illustrates a gap 104 between two conductive units, for example, antenna 102 and ground 108, of a first example prior-art electronic device. Antenna 102 and ground 108 can be disposed on board 100. Board 100 can be disposed inside the first example prior-art electronic device and can have a limited surface area for accommodating various components. Antenna 102 can be configured to transmit electromagnetic waves, such as radio waves or microwaves, generated by a generator 106. Alternatively or additionally, antenna 102 can be configured to receive electromagnetic waves.

As well known in the art, gap 104 with a sufficient width, as illustrated by width 114, may be required so that transmission and/or reception of electromagnetic waves can satisfy one or more requirements such as efficiency, pattern shape, interference, mismatch, etc. Physically increasing width 114 of gap 104 can reduce the capacitance in gap 104, thereby freeing antenna 102 to radiate. Given the limited dimensions of board 100 (and required dimensions of ground 108), width 114 can be increased by, for example, physically reducing width 112 of antenna 102. However, reducing width 112 can have a significant impact on the radiation characteristics of antenna 102. As a result, the transmission and/or reception efficiency can be reduced, for example. Further, reducing width 112 can change the resonance frequency of antenna 102 as well as reducing the bandwidth of antenna 102. An example of a conventional technique for physically reducing the dimensions of an antenna is dielectric loading. This approach is discussed with reference to FIG. 1B herein below.

FIG. 1B illustrates, in a second example prior-art electronic device, dielectric loading component 156 disposed on antenna 152 for reducing width 162 of antenna 152, thereby enabling an increase in width 164 of gap 154 between antenna 152 and ground 108. Dielectric loading component 156 can be configured to reduce the resonant frequency of antenna 152, thereby enabling dimensions (e.g., width 162) of antenna 152 to be reduced. Accordingly, width 164 of gap 154 can be widened in order to reduce the aforementioned capacitive effects. However, reducing the width 162 of antenna 152 can cause a significant reduction of the radiation efficiency of antenna 152 itself. In some applications, the efficiency improvement resulted from a widened gap 154 may not be sufficient to compensate for the aforementioned reductions. In these situations, the transmission and/or reception efficiency and bandwidth of the second example prior-art electronic device can be rendered unacceptable when the width of the antenna is reduced.

SUMMARY OF INVENTION

The invention relates, in an embodiment, to an electronic device comprising a first conductive unit and a second conductive unit disposed such that a gap exists between the first component and the second component. The electronic device further includes one or more components disposed along the gap and configured to counteract one or more capacitance effects in the gap, wherein at least one of the first conductive unit and the second conductive unit represents a part of an antenna.

In another embodiment, the invention relates to an electronic device comprising a conductive unit including a slot and one or more components disposed along the slot and configured to counter one or more capacitance effects in the slot.

The above summary relates to only one of the many embodiments of the invention disclosed herein and is not intended to limit the scope of the invention, which is set forth is the claims herein. These and other features of the present invention will be described in more detail below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which:

FIG. 4 illustrates, in accordance with one or more embodiments of the present invention, a tank circuit of the equivalent circuit of FIG. 3 and equations characterizing the tank circuit.

FIG. 6 illustrates, in accordance with one or more embodiments of the present invention, one or more components disposed along a gap between two conductive units and configured to counteract one or more capacitance effects in the gap.

DETAILED DESCRIPTION OF EMBODIMENTS

Figure 1A:
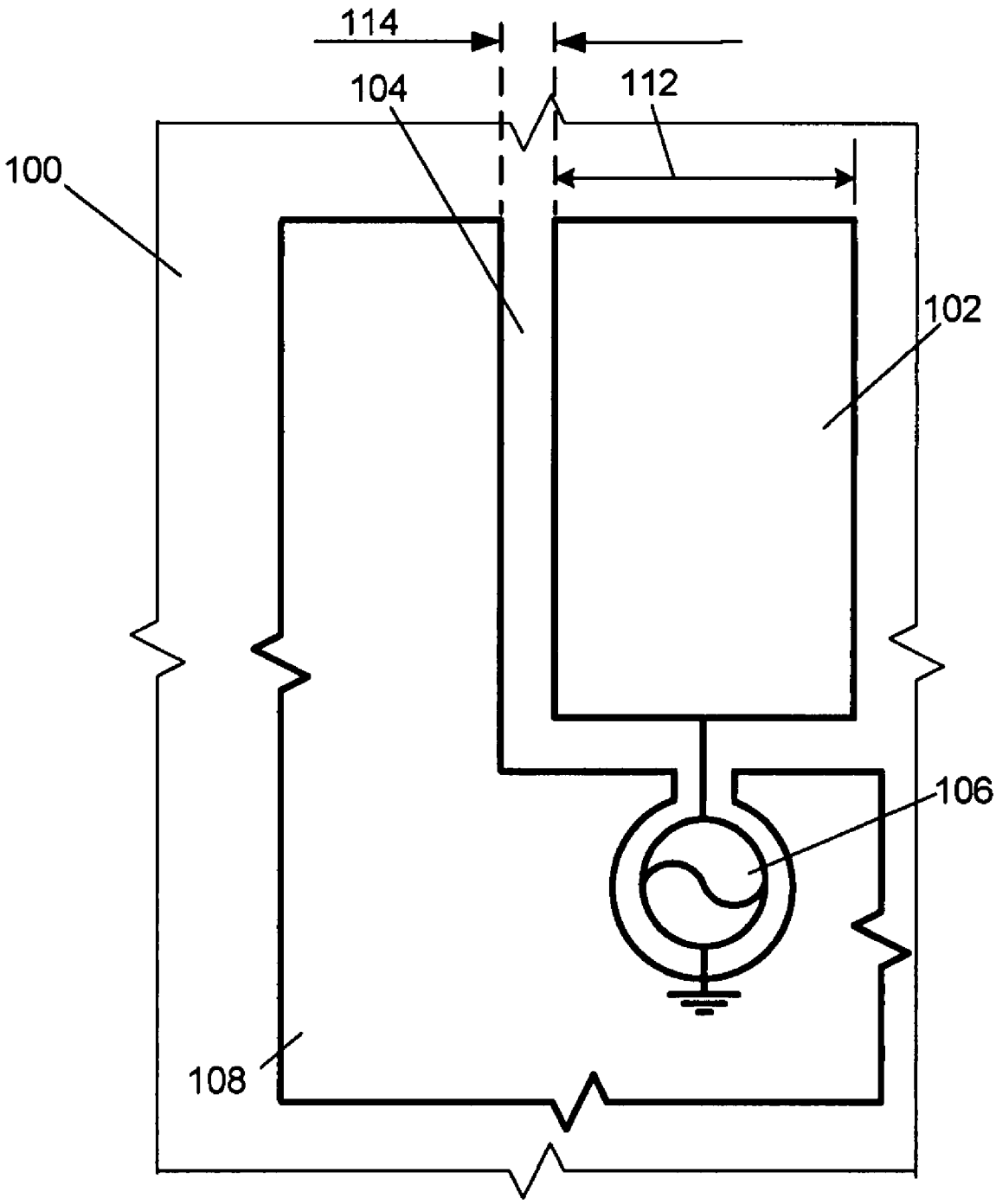
Fig. 1A (Prior Art)
FIG. 1A illustrates a gap between two conductive units, for example, an antenna and a ground, of a first example prior-art electronic device.
Figure 1B:
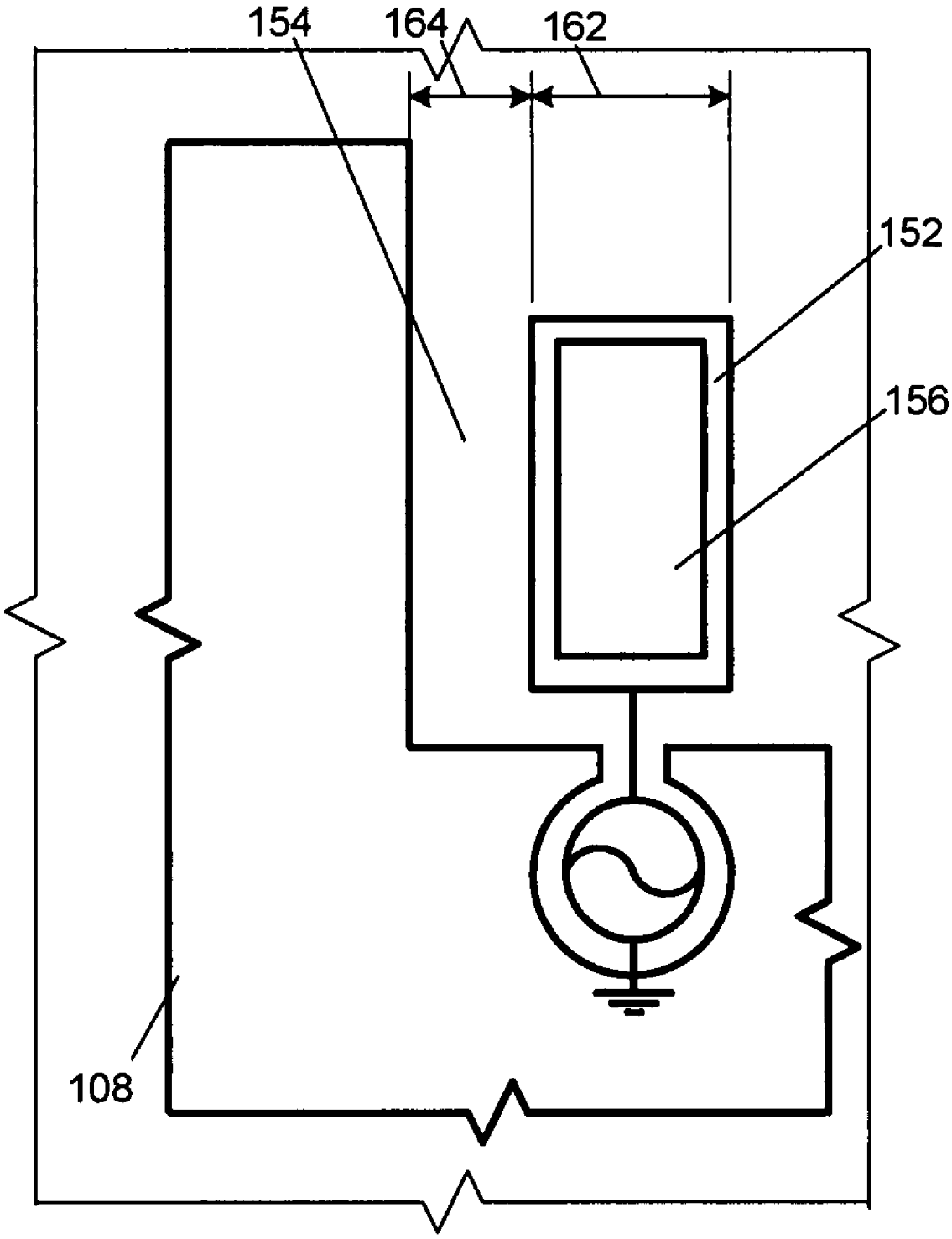
Fig. 1B (Prior Art)
FIG. 1B illustrates dielectric loading disposed on an antenna for reducing a width of the antenna, thereby increasing a width of a gap between the antenna and a ground in a second example prior-art electronic device.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

In one or more embodiments, the invention can relate to an electronic device. The electronic device can include a first conductive unit and a second conductive unit. The first and second conductive units can be disposed such that a gap exists between the first component and the second component. The electronic device can further include one or more components disposed along the gap and configured to counteract one or more capacitance effects in the gap. In one or more embodiments, at least one of the first and second conductive units can be an antenna or part of an antenna.

The term "counteract" as employed herein has the meaning of alter, reduce, minimize or eliminate. Analogously, the term "counteracting" as employed herein has the meaning of altering, reducing, minimizing or eliminating. For example, in an embodiment, the components disposed along the gap has the effect of eliminating the capacitance effects in the gap. As another example, in an embodiment, the components disposed along the gap has the effect of minimizing the capacitance effects in the gap. As another example, in an embodiment, the components disposed along the gap has the effect of reducing the capacitance effects in the gap. As another example, in an embodiment, the components disposed along the gap has the effect of altering the capacitance effects in the gap.

In one or more embodiments, the one or more components can be configured to provide inductive reactance to counteract the effects of the capacitive reactance generated in the gap. In one or more embodiments, the one or more components can include one or more inductive components, magnetic components, inductor equivalent magnetic energy storing components. These components may have any suitable form factor, including for example surface-mount devices (SMDs) and/or inductor-capacitor networks.

In one or more embodiments, at least one inductance value of the one or more components can correspond to at least one of an operating frequency, an operating power level, and an operating duration of the electronic device. The at least one inductance value of the one or more components can be determined based on at least one of one or more widths of the gap and one or more intervals (or spaces) between the one or more components. At least one inductance value of the one or more components (i.e., the one or more inductive components) may be variable.

In one or more embodiments, the number of components in the one or more components can be at least twelve (12) multiplied by a length of the gap and divided by the wavelength.

One or more embodiments of the present invention can relate to an electronic device that can include a conductive unit with a slot. The electronic device can further include one or more components disposed along the slot and configured to counter, alter, minimize or reduce the capacitance effect in the slot.

The features and advantages of the present invention may be better understood with reference to the figures and discussions that follow.

Figure 2:
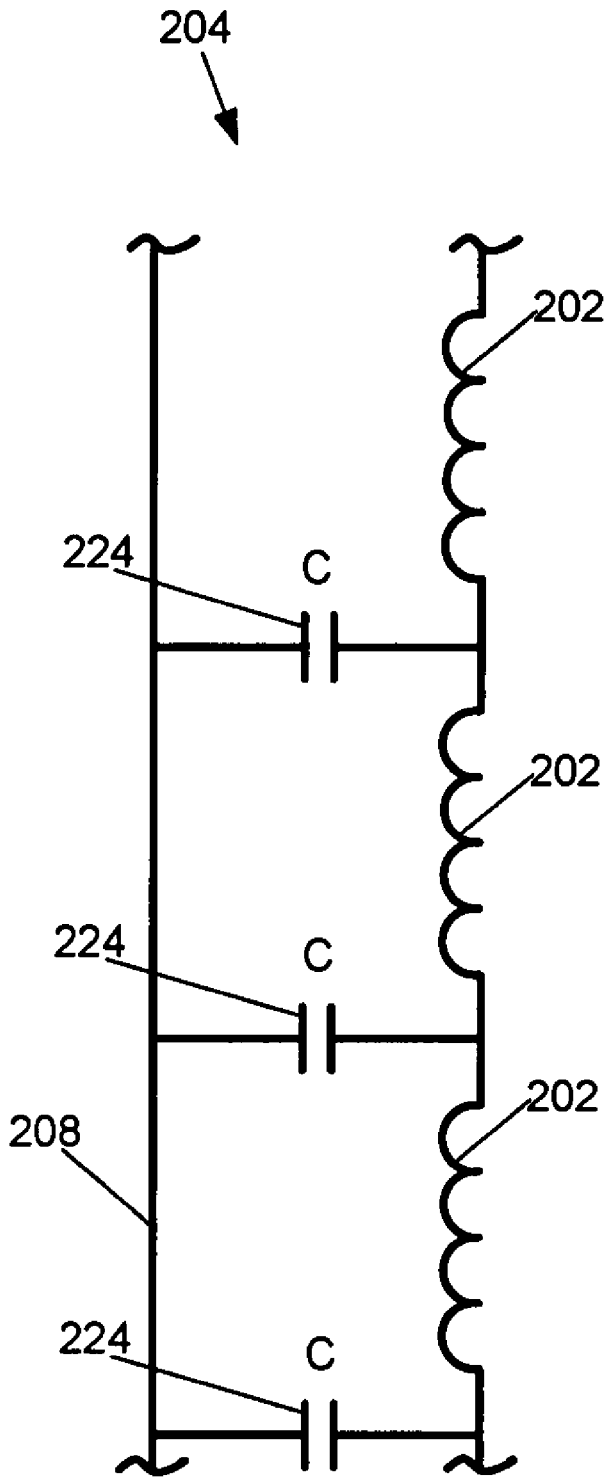
FIG. 2 illustrates, in accordance with one or more embodiments of the present invention, an equivalent circuit for modeling a gap between two conductive units.

FIG. 2 illustrates, in accordance with one or more embodiments of the present invention, an equivalent circuit 204 for modeling a gap between two conductive units, such as gap 104 between antenna 102 and ground 108 shown in the example of FIG. 1A. At least a first conductive unit of the two conductive units can be modeled with a set of inductors 202. At least a second conductive unit of the two conductive units can be modeled with a conductive line 208. The distributed capacitance effects in the gap can be modeled with one or more capacitors 224, such as one or more shunt capacitors, with one or more capacitance values C, disposed along the gap (or along the two conductive units). The one or more capacitance values C may be determined through measurements and/or simulations and calculations based on theoretically derived formulas. Accordingly, the one or more capacitance effects can be counteracted with one or more components deployed along the gap. In some cases, this can be done with or without direct measurement of C.

Figure 3:
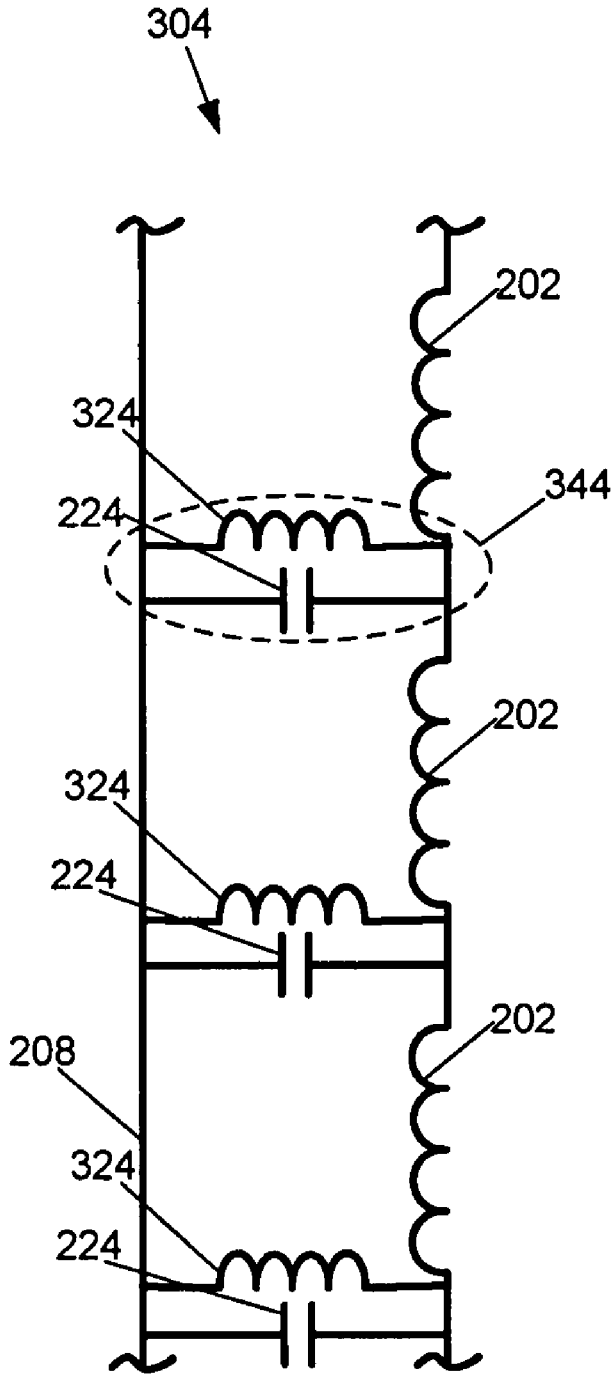
FIG. 3 illustrates, in accordance with one or more embodiments of the present invention, an equivalent circuit for modeling the gap discussed in FIG. 2 with one or more components added along the gap to counteract one or more capacitance effects in the gap.

FIG. 3 illustrates, in accordance with one or more embodiments of the present invention, equivalent circuit 304 for modeling the gap discussed in FIG. 2 with one or more components 324 disposed along the gap to counteract the one or more capacitance effects in the gap. Equivalent circuit 304 can include inductors 202, conductive line 208, and capacitors 224, as in equivalent circuit 204. The one or more components 324 can be configured to provide inductive reactance to neutralize, alter, reduce or minimize the effects of the capacitive reactance associated with the gap. In one or more embodiments, the one or more components 324 can include one or more inductive components, magnetic components, inductor equivalent magnetic energy storing components. As discussed, any suitable form factor may be employed, including for example surface-mount devices (SMDs) and/or inductor-capacitor networks. In one or more embodiments, the one or more components 324 can represent one or more shunt inductors with one or more added shunt inductance values L' (inductance value L'). For equivalent circuit 304, each sub circuit including a pair of capacitor 224 and component 324 can be consider as a LC parallel circuit, or tank circuit 344. The mathematical relationship of C and L' in tank circuit 344 is discussed with reference to FIG. 4.

FIG. 4 illustrates, in accordance with one or more embodiments of the present invention, tank circuit 344 of equivalent circuit 304 of FIG. 3 as well as equations characterizing tank circuit 344. An impedance value of tank circuit 344 can be represented by $Z_{C//L'}$ whereby $Z_{C//L'}$ can be determined by capacitance value C of capacitor 224 and inductance value L' of component 324. If tank circuit 344 can be configured such that the value of $Z_{C//L'}$ approaches infinity, tank circuit 344 can become an open circuit, i.e. storing essentially no energy. Accordingly, the one or more capacitance effects in the gap between the two conductive units can be substantially eliminated, and the gap can be considered to be virtually expanded. As a result, in one or more embodiments, the radiation characteristics of electromagnetic waves can be improved. Additionally or alternatively, the efficiency of electromagnetic wave transmission and/or reception can be improved.

In one or more embodiments, capacitance value C can represent a capacitance value per unit length between conductive line 208 and the line represented by series inductors 202 (shown in the example of FIG. 3), or per unit length of the gap, if equivalent circuit 304 (shown in FIG. 3) is modeled such that there is one capacitor 224 per unit length of conductive line 208. Inductance value L' can represent an inductance value per the same unit length of conductive line 208, if equivalent circuit 304 is modeled such that one component 324 is disposed (or deployed) per the same unit length of conductive line 208.

In one or more embodiments, mathematical relationships of $Z_{C//L'}$, C, and L' can be represented for a LC parallel circuit model 401:

$$Z_{C//L'}=((1/j\omega C)\cdot j\omega L')/(1/j\omega C+j\omega L') \quad (401)$$

wherein $Z_{C//L'}$=impedance of tank circuit 344,

C=capacitance per unit length of conductive line 208,

L'=added shunt inductance per same unit length of conductive line 208, $\omega=2\pi f$, and f=operating frequency of tank circuit 344 (such as operating frequency of generator 106 shown in the example of FIG. 1A).

$$Z_{C//L'} \text{ can approach infinity, if } 1/j\omega C+j\omega L' \text{ approaches } 0 \quad (402)$$

Therefore, for $Z_{C//L'}$ to approach infinity, tank circuit 344 (of equivalent circuit 304 shown in the example of FIG. 3) can be configured such that $$L'=1/\omega^2 C \quad (403)$$

$$\text{From the foregoing, } \omega=SQRT(1/L'C) \quad (404)$$

As can be appreciated from the foregoing, inductance value L' can be determined by configuring or measuring operating frequency f and measuring capacitance value C, in order to make $Z_{C//L'}$ sufficiently large to result in a virtually expanded gap. This aspect will be discussed in details later herein. In one or more embodiments, multiple components 324 with inductance value L' can be deployed at an equal interval of the aforementioned unit length along the gap. On the other hand, if L' is predetermined, operating frequency f can be configured to virtually expand the gap.

Alternatively or additionally, L' can be determined experimentally. For example, components with relatively high inductance values can be disposed initially along the gap, and then the inductance values can be gradually reduced (for example, by adjusting the inductance values or replacing the components) until tank circuits (e.g. tank circuit 344) in equivalent circuit 304 (shown in FIG. 3) resonate, which is indicative of an open circuit condition. When the tank circuits resonate, the one or more capacitance effects in the gap can be deemed to be substantially canceled, and the gap can be deemed to be virtually expanded. Accordingly, in one or more embodiments, the electromagnetic wave transmission and/or reception efficiency can thereby be improved.

In one or more embodiments, the inductance values can be further reduced to provide one or more attenuation effects for facilitating transmission line termination.

Figure 5:
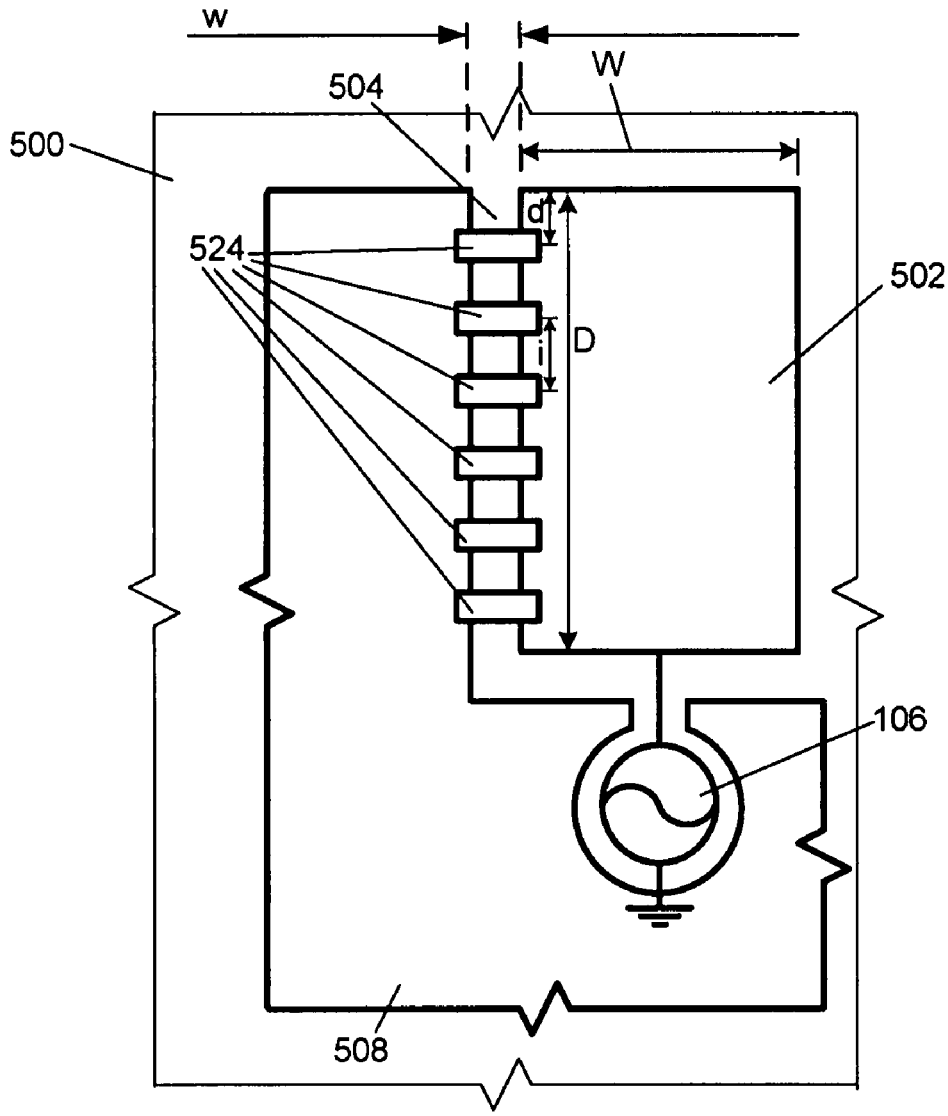
FIG. 5 illustrates, in accordance with one or more embodiments of the present invention, one or more components disposed along a gap between two conductive units and configured to counteract one or more capacitance effects in the gap.

FIG. 5 illustrates, in accordance with one or more embodiments of the present invention, one or more components 524 disposed along gap 504 between first conductive unit 502 and second conductive unit 508 and configured to counteract one or more capacitance effects in gap 504. In one or more embodiments, gap 504 can be modeled utilizing an equivalent circuit similar to equivalent circuit 304 shown in the example of FIG. 3. Accordingly, the inductance values of the one or more components 524 can be determined utilizing, for example, one or more of equations 401-404 discussed above and shown in FIG. 4. Accordingly, the one or more capacitance effects in gap 504 can be neutralized, altered, reduced, or minimized.

In one or more embodiments, first conductive unit 502 can represent an antenna or part of an antenna. The antenna can be coupled to generator 106 and configured to transmit electromagnetic waves. Alternatively or additionally, first conductive unit 502 can be configured to receive electromagnetic waves (or signals). In one or more embodiments, second conductive unit 508 can represent the ground. Conductive units 502 and 508 can be disposed on board 500 of an electronic device, for example.

In one or more embodiments, the one or more components 524 are configured according to one or more of equations 401-404 such that gap 504 is virtually expanded with capacitance effects reduced or canceled. As a result, the efficiency for the radiative transmission and/or reception can be enhanced without gap width w or first conductive unit width W being physically modified. Preserving the dimensions w and W can advantageously save redesign and/or manufacturing costs in many situations.

On the other hand, the gap width w can be physically reduced without unduly compromising the radiative transmission and/or reception efficiency or the bandwidth. As a result, the form factor of the electronic device can be reduced without compromising the device's performance.

Alternatively or additionally, the gap width w can be physically reduced with the first conductive unit width W being physically increased. As a result, the resonance of first conductive unit 502 can be improved, and therefore the radiative transmission and/or reception efficiency and/or bandwidth of the electronic device can be advantageously enhanced. Since the gap width w is physically reduced concomitantly with the enlargement of the first conductive width W, the performance increase can be achieved without having to enlarge the overall form factor of the electronic device.

One or more embodiments of the present invention also relate to the determination of the number (or quantity) of the one or more components 524. In one or more embodiments, based on experimental results, the number of the one or more components 524 (added components) for effectively canceling the one or more capacitance effects can be determined. In some cases, the number of the one or more components 524 may depend on length D of gap 504 and wavelength λ of the electromagnetic waves:

$$\text{Number of added components} \geqq 3(\lambda/(4D)), \text{ i.e.,}$$

$$\text{Number of added components} \geqq 12D/\lambda \ldots . \quad (501)$$

wherein

D=length of gap 504, and

λ=wavelength of operating frequency f.

Wavelength λ is related to operating frequency of the electromagnetic waves:

$$\lambda=c/f \quad (502)$$

wherein c=velocity of light, and f=operating frequency.

In one or more embodiments, the number of the one or more components 524 is at least 12D/λ in order for the one or more capacitance effects to be effectively canceled. For example, if gap 504 length D is half of the wavelength λ, i.e., λ/2, at least six (6) of components 524 can be deployed along gap 504, as illustrated in the example of FIG. 5.

One or more embodiments of the present invention also relate to positioning the one or more components 524 in order to effectively cancel, alter, reduce, or minimize the one or more capacitance effects. In one or more embodiments, based on experimental results, a first component among the one or more components 524 can be disposed at most one twenty-fourth (1/24) of wavelength λ from at least one end of first conductive unit 502. For example, in the example of FIG. 5, the distance from the end of the conductive unit (denoted by d) is λ/24 or less.

Alternatively or additionally, in one or more embodiments, based on experimental results, a first component among the one or more components 524 can be disposed at most one twelfth (1/12) of wavelength λ from at least one end of first conductive unit 502. For example, in the example of FIG. 5, d is about λ/12 or less.

In one or more embodiments, the one or more components 524 can have the same inductance value. Alternatively, some components among the one or more components 524 can have different inductance values. Further, one or more components 524 can be distributed along gap 504 at different intervals, for example, for optimal layout of parts of the electronic device.

As illustrated in the example of FIG. 5, in one or more embodiments, the one or more components 524 can be distributed along gap 504 at equal interval i. In one or more embodiments, the one or more components 524 can be distributed along gap 504 at different intervals. Different intervals for deploying the counter-capacitance components can be discussed with reference to the example of FIG. 6.

FIG. 6 illustrates, in accordance with one or more embodiments of the present invention, one or more components 621-624 disposed along gap 650 between conductive units 611 and 612 and configured to counteract one or more capacitance effects in gap 650. Gap 650 can include sections 651 and 652, which can have width $w_1$ and $w_2$, respectively. Width $w_1$ and $w_2$ can be different. Components 621-622 can be disposed along section 651 at interval $d_1$, and components 623-624 can be disposed along section 652 at interval $d_2$, for counteracting one or more capacitance effects in respective sections. Interval $d_1$ can be different from interval $d_2$. Alternatively or additionally, an inductance value of components 621-622 can be different from an inductance value of components 623-624. In one or more embodiments, components 621-622 can have different inductance values, and/or components 623-624 can have different inductance values.

In one or more embodiments, inductance values of components 621-624 and/or intervals of components 621-624 (e.g., intervals $d_1$ and $d_2$) can be determined utilizing equations such as, for example, those characterizing the following LC parallel circuit model 601, equivalence capacitance models 602-603, and capacitance models 604-605.

$$Z_e = ((1/j\omega C)\cdot j\omega L')/(1/j\omega C + j\omega L') = j\omega L'/(1-\omega^2 L' C) \quad (601)$$

$$Z_e = 1/j\omega C_e \quad (602)$$

From equations 601-602, $C_e = C - 1/(\omega^2 L')$ (603)

wherein $Z_e$=an effective impedance of a tank circuit modeling a section of gap 650, C=a capacitance value of the tank circuit, L'=an inductance value of the tank circuit, ω=2πf, f=operating frequency, and $C_e$=an effective capacitance for the section of gap 650.

Capacitance models provide relationships of parameters including one or more of inductance values, gap widths, and intervals. To simplify the expression, conductor thicknesses are made unity, and fringe capacitance is neglected.

$$d_1 = w_1 \cdot C_{e1}/\in = (w_1/\in)\,(C_1 - 1/(\omega^2 L_1')) \quad (604)$$

$$d_2 = w_2 \cdot C_{e2}/\in = (w_2/\in)\,(C_2 - 1/(\omega^2 L_2')) \quad (605)$$

wherein

∈=permittivity of gap 650, $d_1$=the interval between components 621-622, or a conductive line length in the capacitance model, $w_1$=the gap width of section 651, or a separation/space between two conductive lines in the capacitance model, $C_{e1}$=an effective capacitance for section 651, $C_1$=a capacitance effect to be neutralized in section 651, $L_1'$=an inductance value of component 621 or 622, $d_2$=the interval between components 623-624, or a conductive line length in the capacitance model, $w_2$=the gap width of section 652, or a separation/space between two conductive lines in the capacitance model, $C_{e2}$=an effective capacitance for section 652, $C_2$=a capacitance effect to be neutralized in section 652, and $L_2'$=an inductance value of component 623 or 624.

One or more parameters in equations 604-605 can be configured, for example, for meeting certain design and/or performance requirements. For example, if $w_1<w_2$, components 621-624 can be configured such that $d_1<d_2$. Alternatively or additionally, components 621-624 can be configured from equation 603 so that $L_1'<L_2'$. For example, if $w_1=w_2$ and $d_1<d_2$, components 621-624 can be configured such that $L_2'<L_1'$.

Components 621-624 can be disposed along gap 650 according various cost-saving and/or efficiency-improving considerations. In one or more embodiments, nonconductive medium 680 can be provided to carry components 621-624, for example, for facilitating alignment in manufacturing an electronic device that include conductive units 611-612 and components 621-624. Components 621-624 can be pre-attached to nonconductive medium 680 before being applied to gap 650. In one or more embodiments, nonconductive medium 680 can be formed of epoxy or a similarly suitable medium. Alternatively or additionally, one or more of components 621-624 can be soldered to at least one of conductive units 611-612. Alternatively or additionally, one or more of components 621-624 can be pre-printed on board 600 before conductive units 611-612 are installed on board 600. One or more of components 621-624 can contact both of conductive units 611-612.

Figure 7:
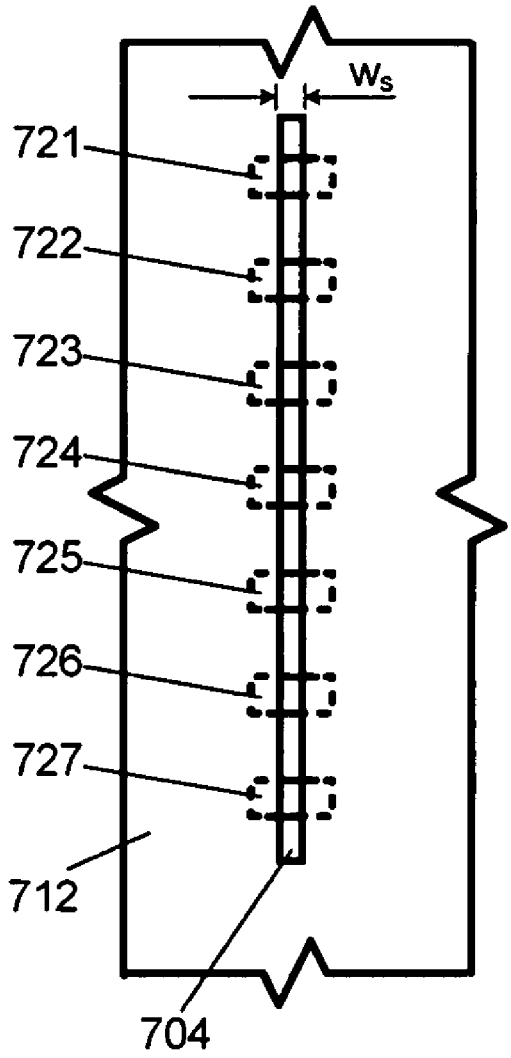
FIG. 7 illustrates, in accordance with one or more embodiments of the present invention, components disposed along a slot of a conductive unit and configured to counteract one or more capacitance effects in the slot.

FIG. 7 illustrates, in accordance with one or more embodiments of the present invention, components 721-727 disposed along slot 704 of conductive unit 712 and configured to counteract one or more capacitance effects in slot 704. In one or more embodiments, conductive unit 712 can have one or more of above-mentioned characteristics pertaining to one or more of conductive units 502, 508, and 611-612 (shown in the examples of FIGS. 5-6). In one or more embodiments, slot 704 can have one or more of above-mentioned characteristics pertaining to gap 504 (shown in the example of FIG. 5) and/or gap 650 (shown in the example of FIG. 6). In one or more embodiments, one or more of components 721-727 can be configured in ways that are analogous to those discussed with respect to one or more above-mentioned embodiments pertaining to one or more of components 524 (shown in the example of FIG. 5) and/or components 621-624 (shown in the example of FIG. 6).

In one or more embodiments, conductive unit 712 can form an exterior part of an electronic device, and width $w_s$ of slot 704 can be physically reduced such slot 704 can be inconspicuous to users and/or substantially resistant to contaminants (i.e., foreign matters). As a result, for the electronic device, aesthetics can be enhanced and/or contamination can be reduced. Further, the structural integrity of the electronic device also can be reinforced.

Figure 8:
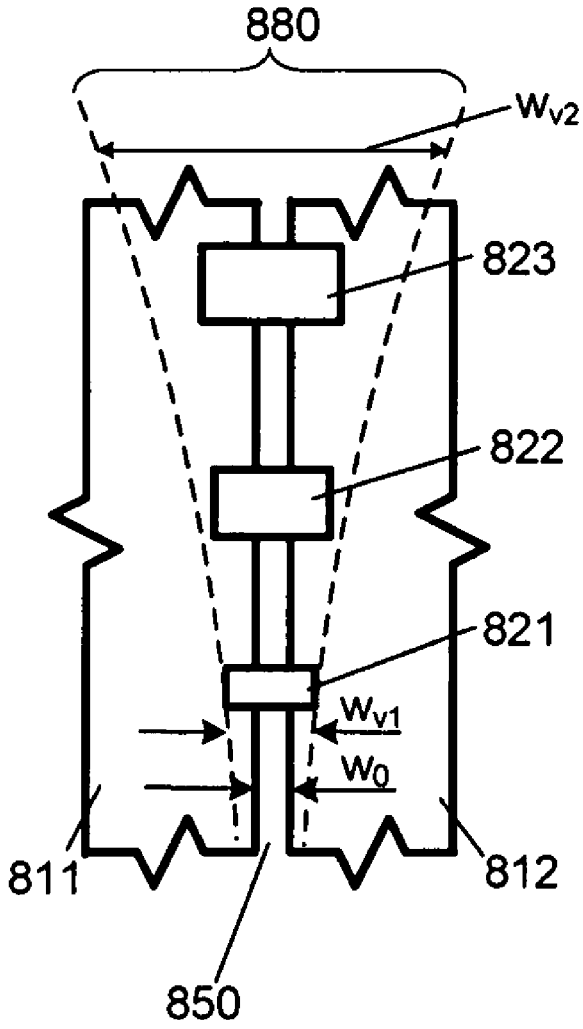
FIG. 8 illustrates, in accordance with one or more embodiments of the present invention, one or more components disposed along a gap between two conductive units and configured to counteract one or more capacitance effects in the gap to various extents.

FIG. 8 illustrates, in accordance with one or more embodiments of the present invention, one or more components 821-823 disposed along gap 850 between two conductive units 811 and 812 and configured to counteract one or more capacitance effects in gap 850 to different degrees or in different ways. As can be appreciated with reference to previous discussions, by counteracting capacitance effects in gap 850, components 821-823 can virtually expand width $w_0$ of gap 850. In one or more embodiments, components 821-823 can have different characteristics such that widths $w_0$ of gap 850 in different portions of the gap are virtually expanded to different degrees and/or in different ways. The different characteristics of components 821-823 can include one or more of inductance values, dimensions, materials, and intervals and can be determined experimentally and/or analytically for a desirable configuration of virtual gap 880. For example, components 821-823 can result in virtual gap 880 with different widths $w_{v1}$ and $w_{v2}$ such that width $w_{v2}$ is greater than width $w_{v1}$. Advantageously, in one or more embodiments, virtual gap 880 can have a horn-shaped, or gradually enlarging, configuration such that the radiation bandwidth of at least one of conductive units 811 and 812 can be substantially increased.

As can be appreciated from the foregoing, embodiments of the present invention can virtually expand gaps between conductive units and/or for slots in conductive units. As discussed, this approach effectively cancels, alters, reduces or minimizes the capacitance effects in the gaps and/or slots, thereby advantageously improving performance without physically altering dimensions of existing elements of the electronic device. Further, embodiments of the present invention can physically minimize gaps and/or slots of an electronic device thereby enabling a reduction in the form factor of the electronic device, without compromising performance. Physically minimizing the gaps and/or slots also can advantageously provide room for accommodating different designs and/or components (such as higher performance designs and/or higher performance parts). An example of a higher performance part that may be accommodated is an antenna with a larger surface area and bandwidth. Further, physically minimizing the gaps and/or slots also can advantageously improve aesthetics, contamination resistance, and/or structural robustness of the electronic device.

While this invention has been described in terms of several embodiments, there are alterations, permutations, and equivalents, which fall within the scope of this invention. It should also be noted that there are many alternative ways of implementing the methods and apparatuses of the present invention. Furthermore, embodiments of the present invention may find utility in other applications. The abstract section is provided herein for convenience and, due to word count limitation, is accordingly written for reading convenience and should not be employed to limit the scope of the claims. It is therefore intended that the following appended claims be interpreted as including all such alternations, permutations, and equivalents as fall within the true spirit and scope of the present invention.

What is claimed is:

1. An electronic device comprising:

a conductive unit including a slot; and one or more components disposed along the slot and configured to counter one or more capacitance effects in the slot, wherein the one or more components include one or more inductive components and wherein at least one inductance value of the one or more inductive components is variable.

2. The electronic device of claim 1 wherein the conductive unit represents a part of an antenna.

3. The electronic device of claim 1 wherein the conductive unit is configured to perform at least one of transmission and reception of electromagnetic waves.

4. The electronic device of claim 3 wherein the number of components in the one or more components is at least twelve (12) multiplied by a length of the slot and divided by a wavelength of the electromagnetic waves.

5. The electronic device of claim 3 wherein a first component among the one or more components is disposed at most one twelfth (1/12) of a wavelength of the electromagnetic waves from at least one end of the conductive unit.

6. The electronic device of claim 3 wherein a first component among the one or more components is disposed at most one twenty-fourth (1/24) of a wavelength of the electromagnetic waves from at least one end of the conductive unit.

7. The electronic device of claim 1 wherein the one or more components include one or more surface-mount devices.

8. The electronic device of claim 1 wherein the one or more components include one or more inductor-capacitor networks.

9. The electronic device of claim 1 wherein the one or more components represent a plurality of components having an equal inductance value.

10. The electronic device of claim 1 wherein the one or more components represent a plurality of components having different inductance values.

11. The electronic device of claim 10 wherein the different inductance values are determined using at least one of widths of the slot and intervals of the plurality of components.

12. The electronic device of claim 1 wherein at least one inductance value of the one or more components corresponds to at least one of an operating power level and an operating duration of the electronic device.

13. The electronic device of claim 1 wherein the one or more components represent a plurality of components distributed along the slot at an equal interval.

14. The electronic device of claim 1 wherein the one or more components represent a plurality of components distributed along the slot at different intervals.

15. The electronic device of claim 14 wherein the different intervals relate to at least one of widths of the slot and inductance values of the plurality of components.

16. The electronic device of claim 1 further comprising a nonconductive medium configured to carry the one or more components.

17. The electronic device of claim 1 wherein the one or more components counteract the one or more capacitance effects to different extents.

* * * * *